US007240386B1

(12) United States Patent
McKay et al.

(10) Patent No.: US 7,240,386 B1
(45) Date of Patent: Jul. 10, 2007

(54) MULTI-LAYER MATTRESS WITH AN AIR FILTRATION FOUNDATION

(75) Inventors: Larry C. McKay, Oak Brook, IL (US); David J. Roberts, Tinley Park, IL (US)

(73) Assignee: King Koil Licensing Company, Inc., Hinsdale, IL (US)

( * ) Notice: Subject to any disclaimer, the term of this patent is extended or adjusted under 35 U.S.C. 154(b) by 0 days.

(21) Appl. No.: 11/133,582

(22) Filed: May 20, 2005

Related U.S. Application Data

(60) Provisional application No. 60/572,693, filed on May 20, 2004.

(51) Int. Cl.
*A47C 27/15* (2006.01)
*A47C 21/04* (2006.01)

(52) U.S. Cl. ..... 5/724; 5/423; 5/726; 5/727; 5/740

(58) Field of Classification Search ..... 5/726, 5/724, 423, 727, 740
See application file for complete search history.

(56) References Cited

U.S. PATENT DOCUMENTS

| | | | | |
|---|---|---|---|---|
| 2,425,655 | A * | 8/1947 | Tompkins | 601/57 |
| 3,266,064 | A * | 8/1966 | Murray | 5/726 |
| 3,486,177 | A * | 12/1969 | Marshack | 5/726 |
| 3,521,311 | A * | 7/1970 | Cohen | 5/727 |
| 4,580,301 | A * | 4/1986 | Ludman et al. | 5/724 |
| 5,136,740 | A | 8/1992 | Kraft | |
| 5,850,648 | A * | 12/1998 | Morson | 5/724 |
| 6,159,574 | A * | 12/2000 | Landvik et al. | 428/71 |
| 6,269,504 | B1 * | 8/2001 | Romano et al. | 5/690 |
| 6,336,237 | B1 * | 1/2002 | Schmid | 5/726 |
| 7,059,001 | B2 * | 6/2006 | Woolfson | 5/740 |
| 2004/0237206 | A1 * | 12/2004 | Webster et al. | 5/727 |
| 2005/0076446 | A1 * | 4/2005 | Fogg | 5/690 |
| 2005/0210595 | A1 * | 9/2005 | Di Stasio et al. | 5/740 |

* cited by examiner

*Primary Examiner*—Alexander Grosz
(74) *Attorney, Agent, or Firm*—Neal, Gerber & Eisenberg LLP

(57) ABSTRACT

A breathable mattress including a plurality of layers, where one of the mattress layers is further comprised of a plurality of sections and the sections are comprised of different types of materials, which have varying firmnesses and feel, and where each of the layers is comprised of material that is perforated or of an open-cell structure to allow for air circulation. The mattress is supported by an air filtration foundation capable of creating an air flow within the mattress.

5 Claims, 6 Drawing Sheets

MULTI-LAYER MATTRESS WITH AN AIR FILTRATION FOUNDATION

This application claims the benefit of provisional application No. 60/572,693 filed on May 20, 2004, the specification of which is incorporated herein by reference.

BACKGROUND OF THE INVENTION

The present invention relates generally to mattresses and, more particularly, to a multi-layer mattress, which is comprised of various foam materials.

A common problem associated with mattresses is that they are not customized to support the bodies of their users. In fact, most mattresses are comprised of materials which have the same hardness or firmness throughout the mattress. To customize mattresses with respect to multiple users, customized mattresses have been provided, which have two zones of hardness or firmness. Although these mattresses are customized to meet user preferences with respect to hardness or firmness for each of the users, these mattresses are not customized to meet user preferences with respect to the different areas of the body for each of the respective users.

To provide varying firmnesses for mattress constructions, many manufacturers use natural and synthetic fibers and a variety of foams, such as latex, visco-elastic and polyurethane. A common problem with these materials, however, is that they prevent air circulation between the mattress layers. This in turn leads to body heat retention and an uncomfortable sleep for the user.

SUMMARY OF THE INVENTION

To overcome the disadvantages noted above, the present invention is directed to a breathable mattress including a plurality of layers, where one of the mattress layers may be further comprised of a plurality of sections and the sections are comprised of different types of materials, which have varying firmnesses and feel and which may also be comprised of material that is perforated or of an open-cell structure to allow for air circulation, and an air filtration foundation capable of creating an air flow within the mattress.

A better understanding of the objects, advantages, features, properties and relationships of the invention will be obtained from the following detailed description and accompanying drawings which set forth an illustrative embodiment and which are indicative of the various ways in which the principles of the invention may be employed.

BRIEF DESCRIPTION OF THE DRAWINGS

For a better understanding of the invention, reference may be had to a preferred embodiment shown in the following drawings in which.

DETAILED DESCRIPTION

Figure 1:
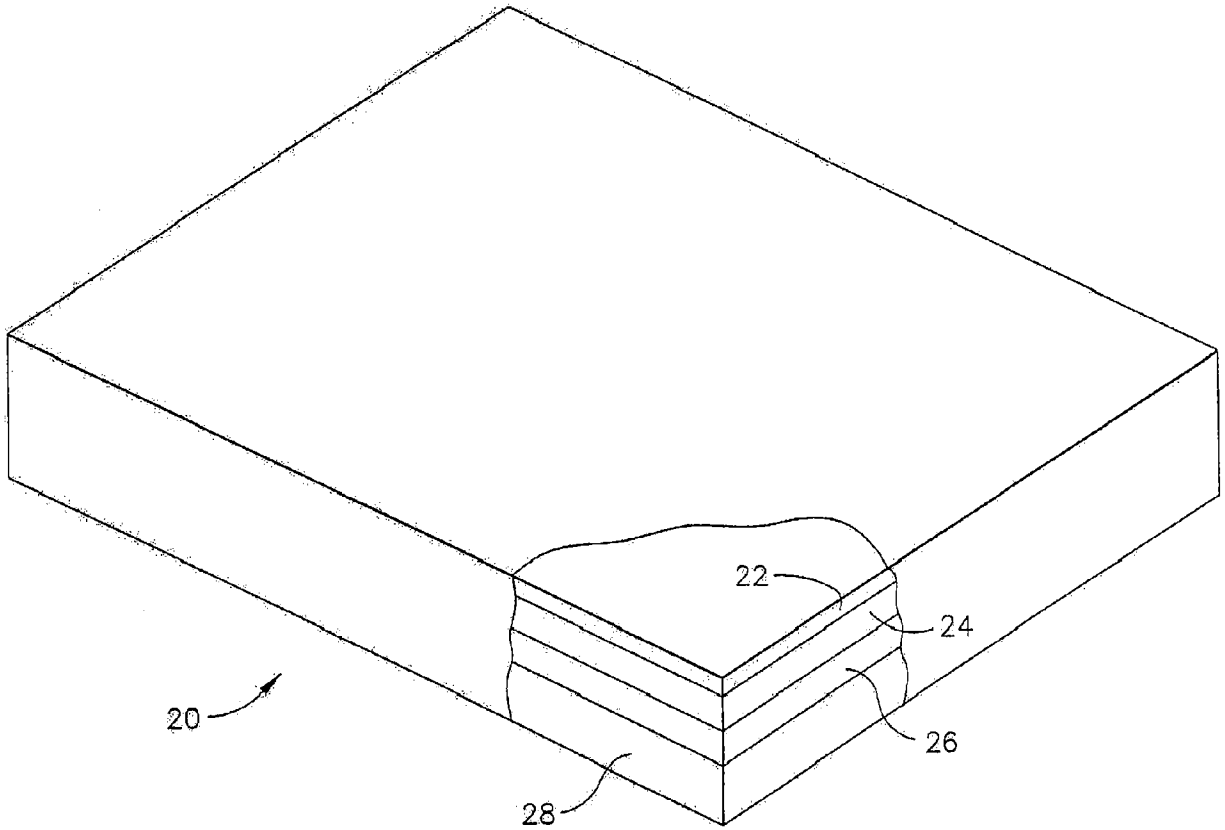
FIG. 1 shows a perspective view of a mattress, which is partially sectioned to show a plurality of foam layers.
Figure 2:
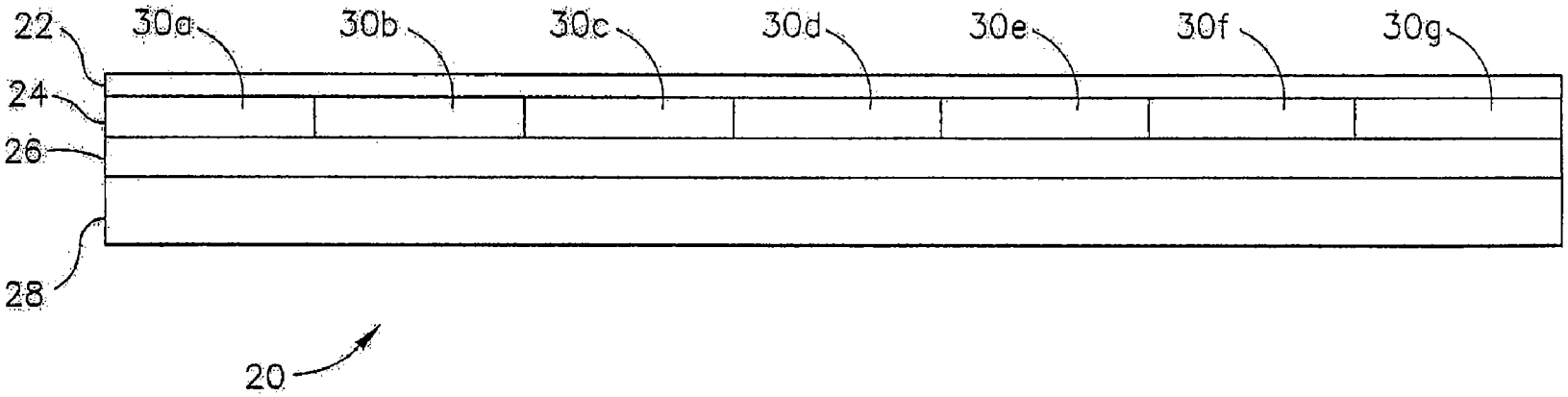
FIG. 2 shows a side view of the foam layers that form the mattress shown in FIG. 1.
Figure 3:
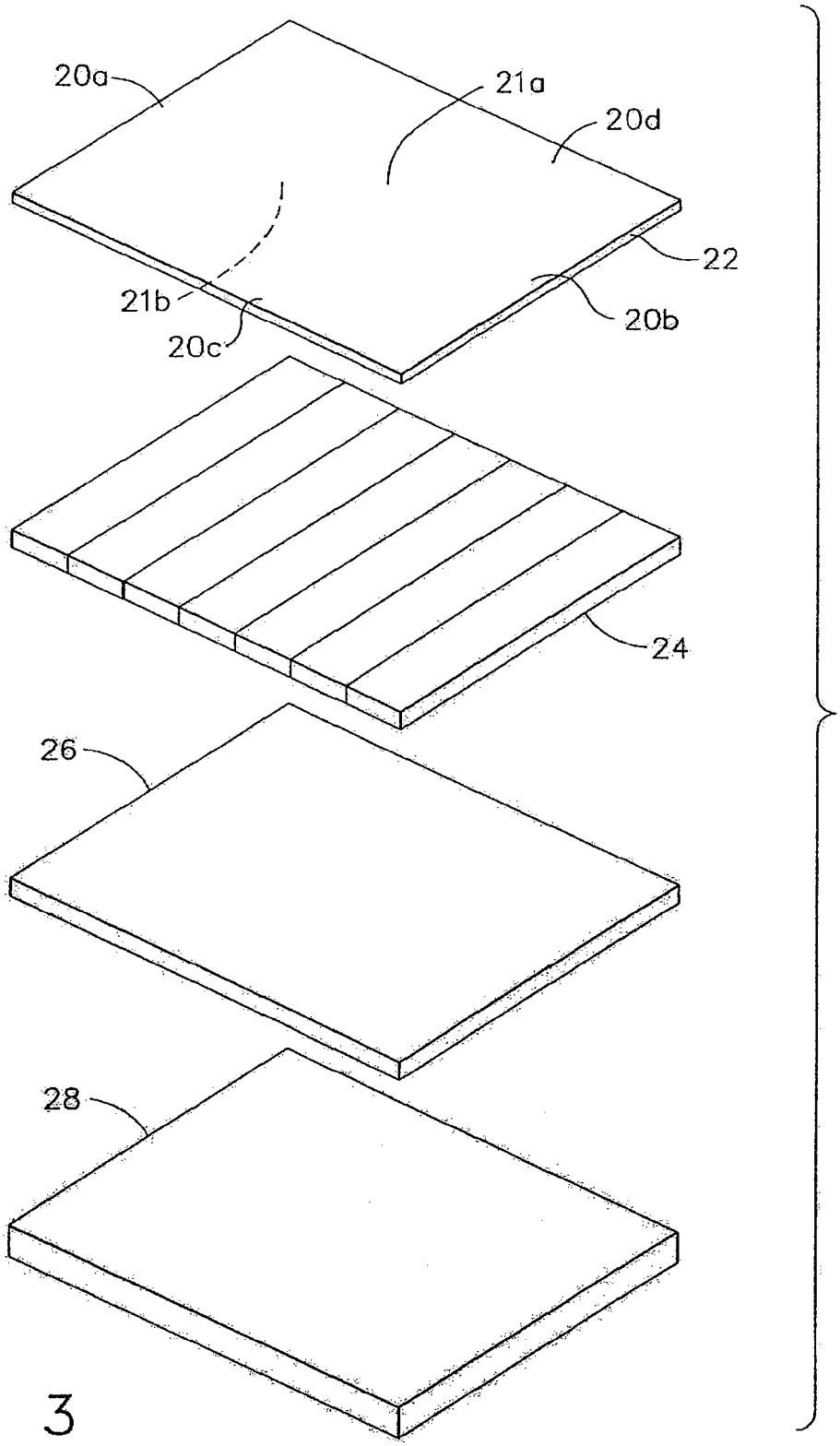
FIG. 3 shows an exploded, perspective view of the foam layers shown in FIG. 2, without the outer mattress cover.

Turning now to the figures, wherein like reference numerals refer to like elements, there is illustrated a mattress 20, which is comprised of multiple foam layers. More particularly, as shown in FIGS. 1 and 2, the mattress 20 is comprised of a comfort layer 22, a contour layer 24, an air foam layer 26, and a foam base layer 28. Although the mattress shown in FIGS. 1 and 2 shows the mattress with comfort layer 22 forming the top layer of mattress 20, contour layer 24 positioned underneath comfort layer 22, air foam layer 26 positioned underneath contour layer 24 and foam base layer 28 forming the bottom layer of mattress 20, it should be understood by those with skill in the art that the order of these layers 22, 24, 26, 28 may be changed.

The comfort layer 22 is preferably positioned on the top of the mattress 20 and is comprised of material that is soft and breathable. For example, materials, including, but not limited to, convoluted latex, regular latex, viscoelastic polyurethane, regular polyurethane or convoluted polyurethane may be used. While it is preferred that the comfort layer 22 be comprised of material having an open-cell structure or being perforated for use in connection with the mattress 20, it should appreciated that other materials may also be used, as long as they possess similar characteristics as the materials mentioned above. Although the comfort layer 22 may be of a varying thicknesses, the preferred embodiment of the present invention includes a comfort layer 22 having a thickness between ½ and 4 inches.

As will be discussed in more detail below, the contour layer 24 will include a plurality of zones, where each of the zones may vary in firmness and feel. For example, the embodiment shown in FIGS. 1–4 depicts a seven-zoned layer that utilizes a combination of viscoelastic foam, which is perforated, and conventional polyurethane foam, which may or may not be perforated. Because the viscoelastic foam is perforated and the conventional polyurethane foam is of an open-cell structure, each of these materials will allow air to circulate through the contour layer 24. While this embodiment includes seven zones, it should be appreciated that the number of zones and the material forming each of these zones may be changed to achieve different firmnesses and feel and air circulation qualities; for example, it is also envisioned that a mattress having a contour layer with five zones may also be manufactured. Although the contour layer 24 may be of a varying thicknesses, the preferred embodiment of the present invention includes a contour layer 24 having a thickness between 1 and 4 inches.

The air foam layer 26 may be comprised of reticulated foam, which has an open-cell structure and allows air to circulate through the air foam layer 26. Reticulated foam is strong, easily fabricated and resistant to chemicals. In addition, reticulated foam typically has pore sizes that range from 4 to 100 pores per inch. This enables reticulated foam to be used in a wide array of applications and also helps to control the permeability associated with those applications. While reticulated foam has been commonly used in connection with a variety of products, it has not been used in connection with mattresses. It should be understood by those with skill in the art that other materials having similar characteristics may also be used to form the air foam layer 26. Although the air foam layer 26 may be of a varying thicknesses, the preferred embodiment of the present invention includes an air foam layer 26 having a thickness between 2 and 4 inches.

The foam base layer 28 is normally positioned on the bottom of the mattress 20 and comprised of material that is firmer and more supportive, such as polyurethane. The foam base layer 28 may also be comprised of a material having an open-cell structure for allowing air to circulate through the foam base layer 28. It should be understood by those with skill in the art that other materials or manufacturing techniques, such as perforation, may also be employed to form the foam base layer 28 in order to achieve different firmnesses and feel and air circulation qualities. Although the foam base layer 28 may be of a varying thicknesses, the preferred embodiment of the present invention includes a foam base layer 28 having a thickness between 2 and 6 inches.

For creating the mattress 20 shown in FIGS. 1 and 2, the foam layers 22, 24, 26, 28 extend in a substantially parallel, horizontal direction and are stacked in vertical relation to one another. As is known in the art, each of the foam layers 22, 24, 26, 28 are substantially aligned and interface with each other on their horizontal planes. Each of the foam layers 22, 24, 26 and 28 may be attached by adhesives, such as Simalfa glue.

For exemplary purposes only, the mattress 20 should be viewed as comprising a first side 21*a* and a second side 21*b*, where the first side 21*a* and second side 21*b* form substantially planar surfaces. More specifically, the first side 21*a* and second side 21*b* for the mattress also includes a top portion 20*a*, a bottom portion 20*b*, a left side 20*c* and a right side 20*d*. In addition, the top portion 20*a* will correspond to what is commonly referred to as the head of the mattress 20 and the bottom portion 20*b* will correspond to what is commonly referred to as the foot of the mattress 20. It should be appreciated that each of the foam layers 22, 24, 26, 28 also include a first side, a second side, a top portion, a bottom portion, a left side and a right side, with reference numerals associated with each of those portions or sides that correspond to the reference numerals used to describe the same portions or sides on mattress 20.

To create a breathable mattress 20 that has a plurality of zones having varying firmnesses, which correspond to different parts of a user's body, the contour layer 24 includes a plurality of sections 30 that extend from the left side 24*c* of the contour layer 24 to the right side 24*d* of the contour layer 24. Also, it should be appreciated that sections 30 extend in a substantially perpendicular direction as compared to the space extending between the top portion 20*a* and the bottom portion 20*b*. Moreover, each of these sections 30 may be comprised of different foam types, such as latex, viscoelastic, polyurethane and other similar materials, which may also be perforated if necessary. These sections 30 may be attached to each other by adhesives, such as Simalfa glue, or by using other techniques that are well-known in the industry. The benefits of using different foam types is that the contour layer 24 and the mattress 20 may include a plurality of zones associated with each of these section 30, where each of these zones possess a different firmness and feel. In addition, the benefits of using materials that are either perforated or of an open-cell structure is that air will be allowed to circulate throughout the entire mattress 20, thereby allowing the mattress to provide a "cooler" surface and a more comfortable sleep for its users, which may also reduce tossing and turning.

As mentioned above, it is preferred that each of the foam layers 22, 24, 26, 28 and sections 30 be comprised of materials that are perforated or of an open-cell structure, and that provide the desired firmness and feel. For example, viscoelastic is a unique open cell foam that continuously molds to the shape of an object interfacing with the viscoelastic material based on the temperature of the viscoelastic material. Therefore, viscoelastic foam gets softer as its ambient temperature rises. This is important because mattress users are known to have pressure points associated with different portions of their body. In addition, these pressure points will generate heat. Thus, the viscoelastic foam will become softer and mold itself around the pressure points to reduce the amount of force displaced against those points.

Additionally, latex foam, also known as latex foam rubber, is known in the industry and consists of a network of open, or inner-connecting, cells, which are uniform in size and character. It is advantageous to use latex foam in connection with mattresses because latex foam is capable of molding to the shape of an object that interfaces with the latex foam, while also providing support to the object. Also, because of its open and inner-connecting cell structure, latex foam allows for air circulation, which is consistent with the functional specifications required by the present invention. Since latex foam is more breathable than viscoelastic foam, it retains less heat, which may also reduce the surface temperature of the mattress. Therefore, latex foam may be preferable in some instances.

Figure 4:
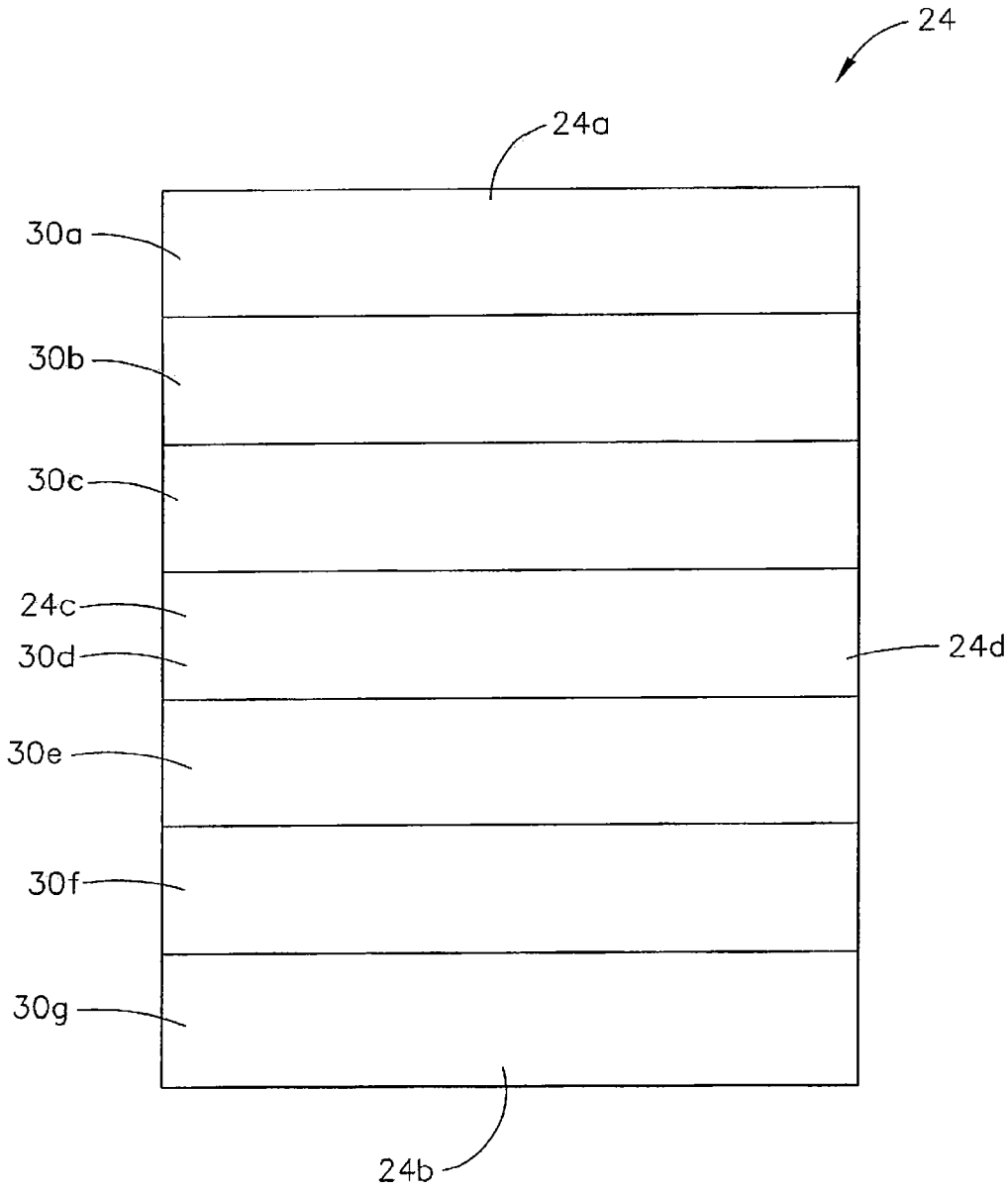
FIG. 4 shows a top view of the contour layer shown in FIG. 3.

As mentioned above, the contour layer 24 includes a plurality of zones, for each of the zones posses a different firmness and feel. Moreover, each of these zones will correlate to one of the sections 30 that form the contour layer 24. FIG. 4 shows a top view of the contour layer 24, including seven sections 30, which may each be comprised of different materials. For example, one embodiment of the present invention includes a contour layer 24 that is comprised of seven sections 30*a*, 30*b*, 30*c*, 30*d*, 30*e*, 30*f*, 30*g*. Moreover, each of the sections are comprised of polyurethane foam or viscoelastic foam and each of those sections 30 may posses the following technical specifications. It should be understood that the density and firmness ranges provided below are only preferred and that materials with a density or firmness outside of the defined ranges may be used without departing from the teachings included herein. It should also be appreciated that the contour layer 24 may be provided with only one section 30 of material, e.g., only one firmness throughout the contour layer 24, provided that the material used therein is of an open-cell structure or perforated thereby allowing airflow throughout the contour layer 24.

Section 30*a*, which may also be referred to as the head portion, may be comprised of polyurethane foam, which may be solid or perforated, having a minimum density of 1.5 lbs./cu. ft. and a firmness rating of between 20–45 Initial Firmness Deflection ("IFD").

Section 30*b*, which may also be referred to as the shoulder portion, may be comprised of viscoelastic foam having a density of between 3–5 lbs./cu. ft. and a firmness rating of between 10–20 IFD.

Section 30*c*, which may also be referred to as the lumbar section, may be comprised of solid polyurethane foam having a minimum density of 1.5 lbs./cu. ft. and a firmness rating of between 20–45 IFD.

Section 30*d*, which may also be referred to as the hip portion, may be comprised of perforated viscoelastic foam having a density of between 3–5 lbs./cu. ft. and a firmness rating of between 10–20 IFD.

Section 30*e*, which may also be referred to as the lower lumbar portion, may be comprised of solid polyurethane foam having a minimum density of 1.5 lbs./cu. ft. and a firmness of between 20–45 IFD.

Section 30*f*, which may also be referred to as the leg portion, may be comprised of perforated viscoelastic foam having a density of 3–5 lbs./cu. ft. and a firmness rating of between 10–20 IFD; and Section 30*g*, which may also be referred to as the foot portion, may be comprised of polyurethane foam, which may be solid or perforated, having a minimum density of 1.5 lbs./cu. ft. and a firmness rating of between 20–45 IFD.

To increase the air flow/circulation of the mattress 20, a fan 40 or similar device may also be provided. The fan may be positioned underneath the mattress 20 or on any of the sides that are formed by the mattress. Because of the preference that the mattress layers 22, 24, 26, 28 be comprised of material that is perforated or of an open-cell structure, the mattress 20 will facilitate the flow/circulation of air and may allow air to pass through the entire mattress. It should also be appreciated by those with skill in the art that the fan 40 may supply air of varying temperatures depending on the effect the manufacturer is aiming to achieve and that more than one fan may be used.

Figure 5:
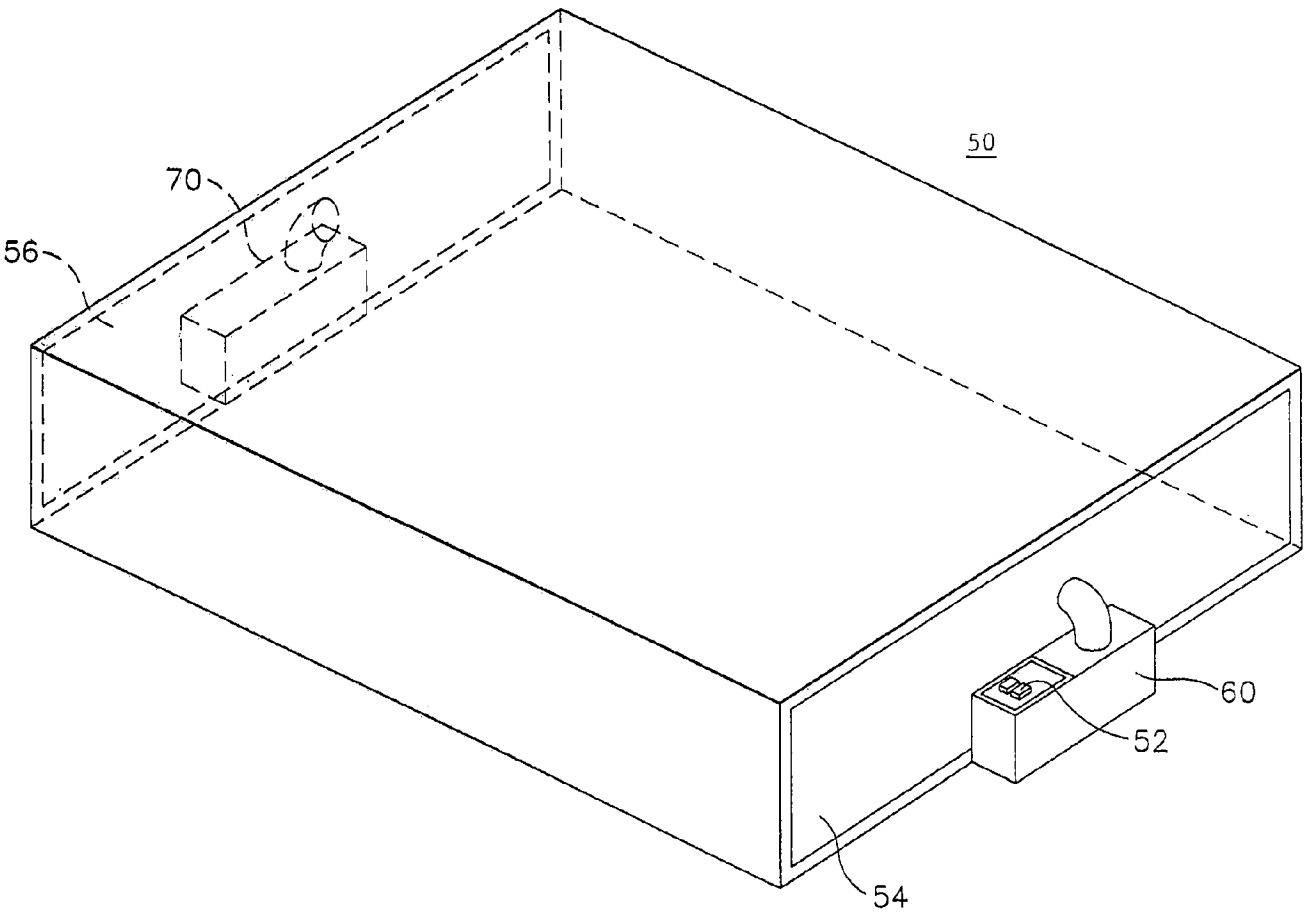
FIG. 5 shows a perspective view of an exemplary air filtration foundation.

To create a controllable air flow, an air filtration foundation 50 may also be included, as shown in FIG. 5. The air filtration foundation 50 may be positioned underneath the mattress 20. Therefore, the air filtration foundation 50 may also serve as the support structure for the mattress 20. The air filtration foundation 50 may be further comprised of a fan assembly 60 and a filter assembly 70. The fan assembly 60 will provide air, which may be at a selected temperature, and the air will flow primarily through the mattress 20. It should be appreciated that the fan assembly 60 may be comprised of standard devices capable of creating an air supply, such as a fan or blower, and that these devices are preferably devices, which produce minimal noise and vibrations. For controlling the level of air flow being provided by the air filtration foundation 50, a control unit 52 may be provided. The control unit 52 may be attached to the air filtration foundation 50 or be mounted remotely. In addition, the control unit 52 may be in electrical communication with the air filtration foundation 50 or communicate with the air filtration foundation 50 via infra-red or other wireless mediums. The control unit 52 may provide the user with various output settings ranging from high to low fan speeds. If a heating and cooling function is desired, the control unit 52 may also include various temperature settings for users to employ.

For purifying or filtering the air and facilitating the controlled air flow, the air filtration foundation 50 may include a combined fan assembly 60 and filter assembly 70, which acts as an intake for the air. To act as an intake for the air, the filter assembly 70 may also include a fan or similar means for drawing air into the filter assembly 70. For removing harmful materials, such as fibers, dust, dust mites, mold spores, tobacco smoke or other allergens, the filter assembly 70 may also include a filter (not shown) for trapping these materials. It should be understood by those with skill in the art that many different filters may be utilized to achieve this function. For example, the filter may be a HEPA, HEGA, carbon, carbon-zeolite mix, ionic, ozone, ultra-violet or electronic filter. While each of these types of filters operates in a different manner, they all act to remove some degree of harmful materials from the air. It should be appreciated that other filters not mentioned above, or not yet developed may also be utilized in connection with the filter assembly described above. It should also be appreciated that although the preferred embodiment of the present invention includes a fan assembly 60 and filter assembly 70 that exist as a single, integrated device, the fan assembly 60 and filter assembly 70 may also be provided on opposite sides of the air filtration foundation 50 or mattress 20. It is also possible that the fan assembly 60 and filter assembly 70 may be positioned underneath (on the underside of) the air filtration foundation 50 and blow or draw air toward or away from the user. It should also be appreciated that the fan assembly 60 and filter assembly 70 may be included as part of the mattress 20.

One embodiment of the present invention may include mounting a combination fan assembly 60 and filter assembly 70 within the air filtration foundation 50. It is also possible that the fan assembly 60 and the filter assembly 70 may be mounted to the sides of the air filtration foundation 50, underneath the air filtration foundation 50 or as a free-standing structure located separate from the air filtration foundation 50. An additional embodiment of the present invention may also be provided which includes only one of either the fan assembly 60 or filter assembly 70 for use in connection with the air filtration foundation 50, as opposed to the a system that includes both.

It is preferred that air be drawn into the air filtration foundation 50 by providing one or more fan assemblies 60 and filter assemblies 70. It is also preferred that each of the fan assemblies 60 and filter assemblies 70 include supply vents 54 and return vents 56 that are positioned within the air filtration foundation 50 and that the air be drawn in a direction that is substantially vertical and substantially transverse to the air filtration foundation 50. However, it is also possible to force air through the air filtration foundation 50 in different directions and to position the fan assembly 60 and filter assembly 70 in different locations with respect to the air filtration foundation 50.

Figure 6:
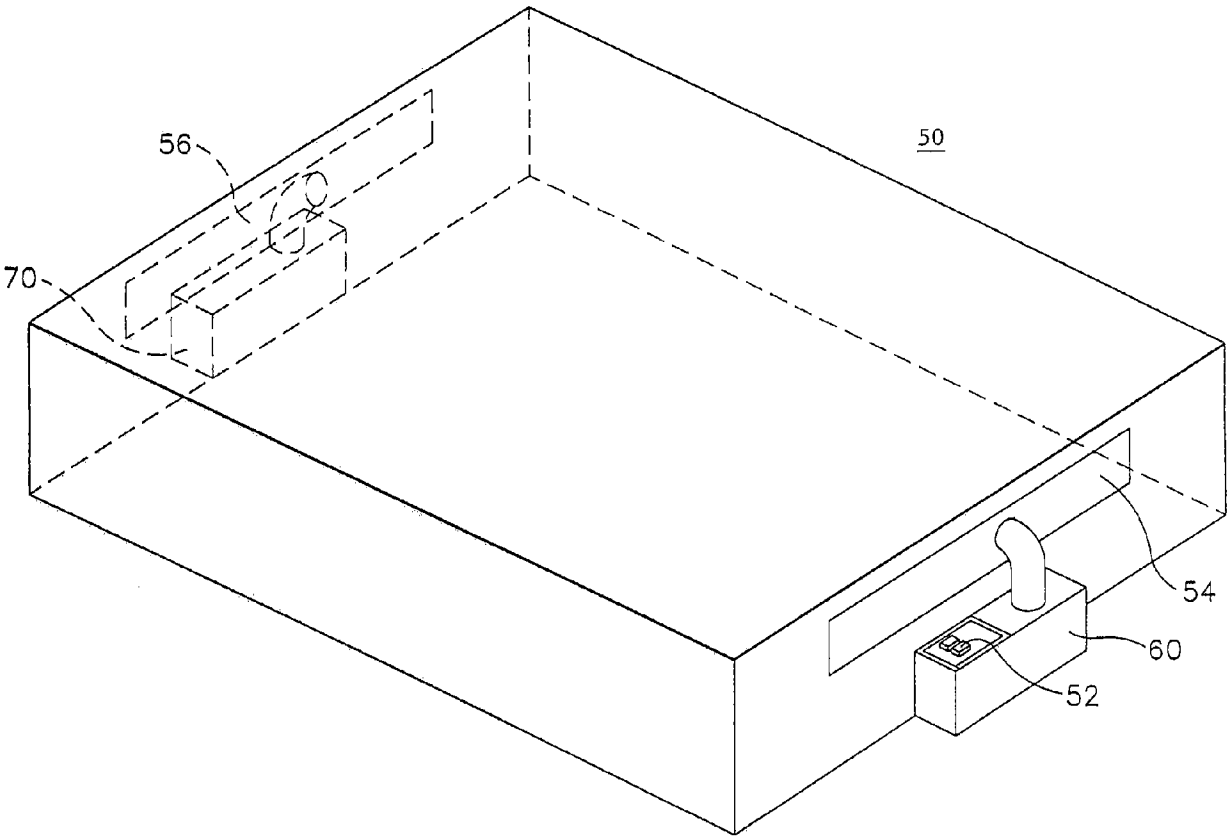
FIG. 6 shows a perspective view of a mattress with an alternative embodiment of an air filtration foundation attached to the mattress.

As shown in FIG. 6, for forcing air through the air filtration foundation 50, a supply vent 54 may connect the fan assembly 60 to the air filtration foundation 50. This air is ultimately directed to the mattress 20. In addition, to filter air that is forced through the air filtration foundation 50 and mattress 20, a return vent 56 may be used to connect the filter assembly 70 to the air filtration foundation 50 and indirectly to the mattress 20. Therefore, air would be supplied by the supply vent 54 and drawn into the filter through the return vent 56. While each of the supply and return vents 54, 56 are preferably positioned near the top portion and bottom portion of the air filtration foundation 50, the vents 54, 56 may be attached to any side of the air filtration foundation 50 or underneath the air filtration foundation 50, in order to create the desired air flow, and the vents 54, 56 may also be of varying sizes and configurations. For example, as shown in FIG. 5, the vents 54, 56 may be designed to cover the entire side on which they are mounted. Alternatively, the vents 54, 56 may be smaller in size, as shown in FIG. 6. The vents 54, 56 may also assume varying shapes (not shown), i.e., square, rectangular, circular or oval, and numbers, i.e., more than one supply or return vents may be provided.

While specific embodiments of the invention have been described in detail, it will be appreciated by those skilled in the art that various modifications and alternatives to those details could be developed in light of the overall teachings of the disclosure. For example, different materials possessing similar characteristics may be used and the positioning of each of the layers with respect to one another may be changed. Accordingly, the particular arrangement disclosed is meant to be illustrative only and not limiting as to the scope of the invention which is to be given the full breadth of the appended claims and any equivalents thereof.

What is claimed is:

1. A mattress, comprising:

a plurality of layers, each layer extending in a substantially parallel, horizontal direction and is positioned in vertical relation to the other layers and having a top portion, a bottom portion, a left side and a right side;

at least one layer being comprised of material selected from the group consisting of convoluted latex, regular latex, viscoelastic polyurethane, regular polyurethane or convoluted polyurethane and having a thickness of between ½ and 4 inches;

at least one of the layers being comprised of a plurality of sections, the sections being comprised of more than one type of material and the different materials having different firmness ratings and at least one of the sections being comprised of latex, at least one of the sections being comprised of viscoelastic and at least one of the sections being comprised of polyurethane foam;

at least one layer being comprised of reticulated foam with pore sizes that range between 4 and 100 pores per inch and having a thickness of between 2 and 4 inches;

at least one layer being comprised of a foam base with an open-cell structure and having a thickness of between 2 and 6 inches;

an air filtration foundation coupled to the mattress;

wherein each of the layers is comprised of a material that allows air to flow through the layer; and wherein the air filtration foundation draws air through the mattress and filters out unwanted particles.

2. The mattress according to claim 1, wherein the plurality of sections are formed between the top portion of the mattress and the bottom portion of the mattress and wherein each of the sections extend from the left side of the mattress to the right side of the mattress.

3. The mattress according to claim 1, wherein the sections are attached to one another by an adhesive materials.

4. The mattress according to claim 1, wherein the plurality of layers include a comfort layer, a contour layer, an air foam layer and a foam base layer.

5. The mattress according to claim 4, wherein the contour layer is comprised of a plurality of sections.

* * * * *